US005322564A

United States Patent [19]

Ludwig et al.

[11] Patent Number: 5,322,564

[45] Date of Patent: Jun. 21, 1994

[54] METHOD AND APPARATUS FOR APPLYING VISCOUS MATERIAL TO A SUBSTRATE

[75] Inventors: Ralf Ludwig, Bielefeld; Robert Murray, Leopoldshöhe; Wolfgang Rosteck, Bielefeld; Heinz Wessel, Bergisch-Gladbach, all of Fed. Rep. of Germany

[73] Assignees: Bollhoff Verfahrenstechnik GmbH & Co. KG, Bielefeld; Ford-Werke AG, Cologne, both of Fed. Rep. of Germany

[21] Appl. No.: 898,000

[22] Filed: Jun. 16, 1992

[30] Foreign Application Priority Data

Jun. 21, 1991 [DE] Fed. Rep. of Germany ..... 4120881

[51] Int. Cl.[5] ..... B05B 15/04; B05B 1/34

[52] U.S. Cl. ..... 118/300; 118/323; 239/424.5; 239/590.5

[58] Field of Search ..... 118/300, 323; 427/421; 239/296, 424.5, 290, 590.5

[56] References Cited

U.S. PATENT DOCUMENTS

| | | | |
|---|---|---|---|
| 1,756,744 | 4/1930 | Hatch | 118/323 |
| 2,715,385 | 8/1955 | Yates | 118/323 |
| 3,049,439 | 8/1962 | Coffman | 118/300 |
| 3,062,455 | 11/1962 | Reip | 239/590.5 |
| 4,891,249 | 1/1990 | McIntyre | 427/421 |
| 4,987,854 | 1/1991 | Hall | 118/323 |
| 4,995,333 | 2/1991 | Keller et al. | 118/300 |

FOREIGN PATENT DOCUMENTS

| | | | |
|---|---|---|---|
| 0362548 | 8/1989 | European Pat. Off. | 118/300 |
| 0293065 | 11/1988 | Fed. Rep. of Germany | 427/421 |
| 3939992 | 6/1991 | Fed. Rep. of Germany | 118/300 |
| 2168266 | 12/1985 | United Kingdom | 118/300 |

*Primary Examiner*—Joseph W. Drodge
*Attorney, Agent, or Firm*—Darby & Darby

[57] ABSTRACT

A layer of viscous material is applied to a substrate by constricting a stream of pressurized viscous material prior to entry into a chamber wherein the constricted filament-shaped stream is acted upon by radially inwardly and forwardly oriented currents of compressed air which reduce the thickness of the stream and issue with such stream from the chamber through an orifice. The orientation of air currents in the chamber is such that the filament is not imparted a swirling movement. The flow of air issuing from the chamber through the orifice forms a hollow cone which surrounds the filament of viscous material on its way toward contact with the substrate.

12 Claims, 1 Drawing Sheet

103
109
2
2a
1
1a
4
5
6
6a
7
8
9
10
11
12
13
14
15
16
17
18
19
20
21
22
23
24
25
26
27
28
29
30
P
II
III

METHOD AND APPARATUS FOR APPLYING VISCOUS MATERIAL TO A SUBSTRATE

BACKGROUND OF THE INVENTION

The invention relates to improvements in methods of and in apparatus for applying viscous material to substrates, e.g., for applying an adhesive or a sealing compound to a workpiece. More particularly, the invention relates to improvements in methods of and in apparatus for applying strips of viscous material with assistance from compressed air or from another compressed gaseous fluid.

Viscous materials of the character under consideration here are those exhibiting a rather high viscosity, preferably higher than about 100 cSt. Such materials are not likely to be atomized by compressed gas but will retain the form of a continuous strand, layer or strip, or at least the form of sections of a layer, strand or strip. An optimum viscosity can be arrived at by varying the temperature and/or by adding effective amounts of a suitable solvent.

U.S. Pat. No. 4,995,333 granted Feb. 26, 1991 to Keller et al. discloses an apparatus for forming a substantially continuous filament of a thermoplastic work material and for imparting a swirling motion to the filament. The configuration of a material discharging nozzle and the construction of the system for supplying a compressed gas are selected in such a way that the filament of thermoplastic material is imparted a swirling motion so that it adheres to a surface in the form of a series of arcs. This is achieved by causing compressed air to flow in a bore extending in parallelism with the filament of thermoplastic material and discharging into a ring-shaped space which is in direct communication with the outlet for air. Swirling motion can be imparted in a number of ways, for example, by providing a gas- or material-discharging bore which is inclined with reference to the longitudinal axis of the apparatus. Alternatively, the material discharging orifice is asymmetrical with reference to the outlet for air.

The swirling motion which is imparted to the filament of thermoplastic material causes such material to deposit on a selected surface in the form of arcs having identical diameters. Thus, if such arcuate deposits of thermoplastic material are to form a continuous strip, they must closely overlap with the result that the marginal zones of the developing strip are higher (i.e., they contain more material) than the median zone. Consequently, if the strip is brought into contact with another surface, the bond between the surface to which the thermoplastic material was applied and the other surface is established primarily along the marginal portions of the strip. This is undesirable irrespective of whether the thermoplastic material is an adhesive or a sealing compound. Moreover, the quantity of thermoplastic material which can be applied per unit of time is relatively small which is unsatisfactory in many, or most, instances if the thermoplastic material is a sealing compound. If the quantity of applied thermoplastic material is raised above a relatively low upper limit, the applied material is likely to be sprayed beyond the selected area and to thus contaminate the workpiece.

OBJECTS OF THE INVENTION

An object of the invention is to provide a method which renders it possible to apply a uniform layer of viscous material to a substrate.

Another object of the invention is to provide a method which renders it possible to apply substantial quantities of viscous material per unit of time without contamination of the surrounding area.

A further object of the invention is to provide a novel and improved method of influencing a filament-shaped stream of viscous material by compressed gaseous fluid.

An additional object of the invention is to provide a novel and improved method of controlling the flow of compressed gaseous fluid toward and with a filament-shaped stream of viscous material.

Still another object of the invention is to provide a method which renders it possible to apply substantial quantities of an adhesive or a sealing compound within short periods of time and in a highly predictable manner.

A further object of the invention is to provide a novel and improved apparatus for the practice of the above outlined method.

Another object of the invention is to provide the apparatus with novel and improved means for controlling the progress of a filament-like stream of viscous material on its way toward contact with a selected substrate.

An additional object of the invention is to provide the apparatus with novel and improved means for controlling the flow of compressed gaseous fluid toward and thereupon jointly with the stream of viscous material.

Still another object of the invention is to provide the apparatus with novel and improved means for regulating the flow of viscous material immediately prior to, during and immediately after contact with compressed gaseous fluid.

A further object of the invention is to provide a simple and inexpensive apparatus which can be connected to available sources of compressed gaseous fluid and pressurized viscous material.

An additional object of the invention is to provide an apparatus which constitutes an improvement over the apparatus of U.S. Pat. No. 4,995,333.

SUMMARY OF THE INVENTION

One feature of the present invention resides in the provision of a method of applying a substantially strip-shaped layer of viscous material (such as an adhesive or a sealing compound) to a substrate, e.g., to the surface of a workpiece. The improved method comprises the steps of confining a filament-shaped stream of pressurized viscous material to movement along an elongated path in a direction toward the substrate, and directing against the moving stream a flow of compressed gaseous fluid (e.g., air) in a predetermined portion of the path which portion is spaced apart from the substrate. The directing step comprises imparting to the gaseous fluid components of flow in the direction toward the substrate as well as radially of the path but at least substantially free of components tangentially of the path (so that the stream does not exhibit a tendency to swirl), and the method further comprises the step of effecting a relative movement of the stream and substrate substantially transversely of the path.

The method preferably further comprises the step of providing a constriction (such as a relatively small orifice) in a portion of the path upstream of and at least close to or immediately adjacent the predetermined portion and/or of providing a constriction (such as a relatively large orifice) in a portion of the path downstream of and at least close to or immediately adjacent the predetermined portion of the path.

The method preferably further comprises the steps of supplying the gaseous fluid in the form of a tubular current, thereupon dividing or breaking up the tubular current into a plurality of elongated currents, and merging the elongated currents into the aforementioned flow of compressed gaseous fluid. The dividing or breaking up step can include converting the tubular current into between six and ten discrete currents.

The method can further comprise the step of pulsating the pressure of compressed gaseous fluid.

Another feature of the present invention resides in the provision of an apparatus for applying a substantially strip-shaped layer of viscous material to a substrate. The apparatus comprises means for confining a filament-shaped stream of pressurized viscous material to movement from a suitable source along a predetermined path in a direction toward the substrate. The confining means defines a chamber which surrounds a predetermined portion of the path, and the confining means has substantially conical surfaces bounding the chamber and tapering in the aforementioned direction toward the path. Tho apparatus further comprises a distributor having at least one inlet which is connected to a suitable source of compressed gaseous fluid. The distributor defines an annular compartment which receives gaseous fluid from the at least one inlet, and the distributor defines (either alone or with the confining means) a plurality of discrete channels which connect the compartment with the chamber. The distribution and orientation of the channels relative to the path is such that the gaseous fluid which enters the chamber and impinges upon the stream in the predetermined portion of the path has components of flow in the aforementioned direction and radially of the path but is at least substantially devoid of components extending tangentially of the path to thus reduce or eliminate the tendency of the stream to swirl on its way from the chamber toward contact with the substrate. The substrate is moved relative to the apparatus and/or vice versa when the apparatus is called upon to form a strip-shaped layer of viscous material.

The compartment preferably surrounds and is sealed from the path for the viscous material. Such compartment is located upstream of the chamber, and the channels are preferably equidistant or at least substantially equidistant from each other (as seen in the circumferential direction of the compartment). The channels are or can be parallel or nearly parallel to the path for viscous material.

The confining means can comprise a length of pipe which surrounds the path and has an external surface confronting the distributor and a flow restricting orifice for viscous material. The orifice defines a second portion of the path immediately or at least closely upstream of the chamber. The distributor can constitute or comprise a tube which surrounds the pipe and has an internal surface adjacent the external surface of the pipe. The internal and external surfaces preferably bound the compartment and the channels can include grooves which are provided in at least one of the internal and external surfaces. The compartment can constitute a recess in at least one of the internal and external surfaces. In accordance with a presently preferred embodiment, the grooves are provided in the external surface of the pipe and the recess is provided in the internal surface of the tube.

The channels can extend from the chamber at least substantially to the at least one inlet for gaseous fluid. Such inlet or inlets are located upstream of the chamber.

The channels are elongated and preferably form an annulus having a diameter which measures at most one-third of the length of a channel.

The at least one inlet preferably extends laterally of the compartment, particularly at least substantially radially of the tube and of the compartment between the external surface of the pipe and the internal surface of the tube.

The number of channels is preferably between six and ten.

The cross-sectional area of the chamber is or can be at least substantially constant, as measured in planes extending at right angles to the path and spaced from each other in the direction of advancement of the stream of viscous material along its path.

The pipe of the confining means can be provided with a relatively small orifice forming part of the path immediately upstream of the chamber, and a cap of the confining means can be provided with a larger second orifice forming part of the path immediately downstream of the chamber.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figures 1, 2, 3, 4, 5, 6:
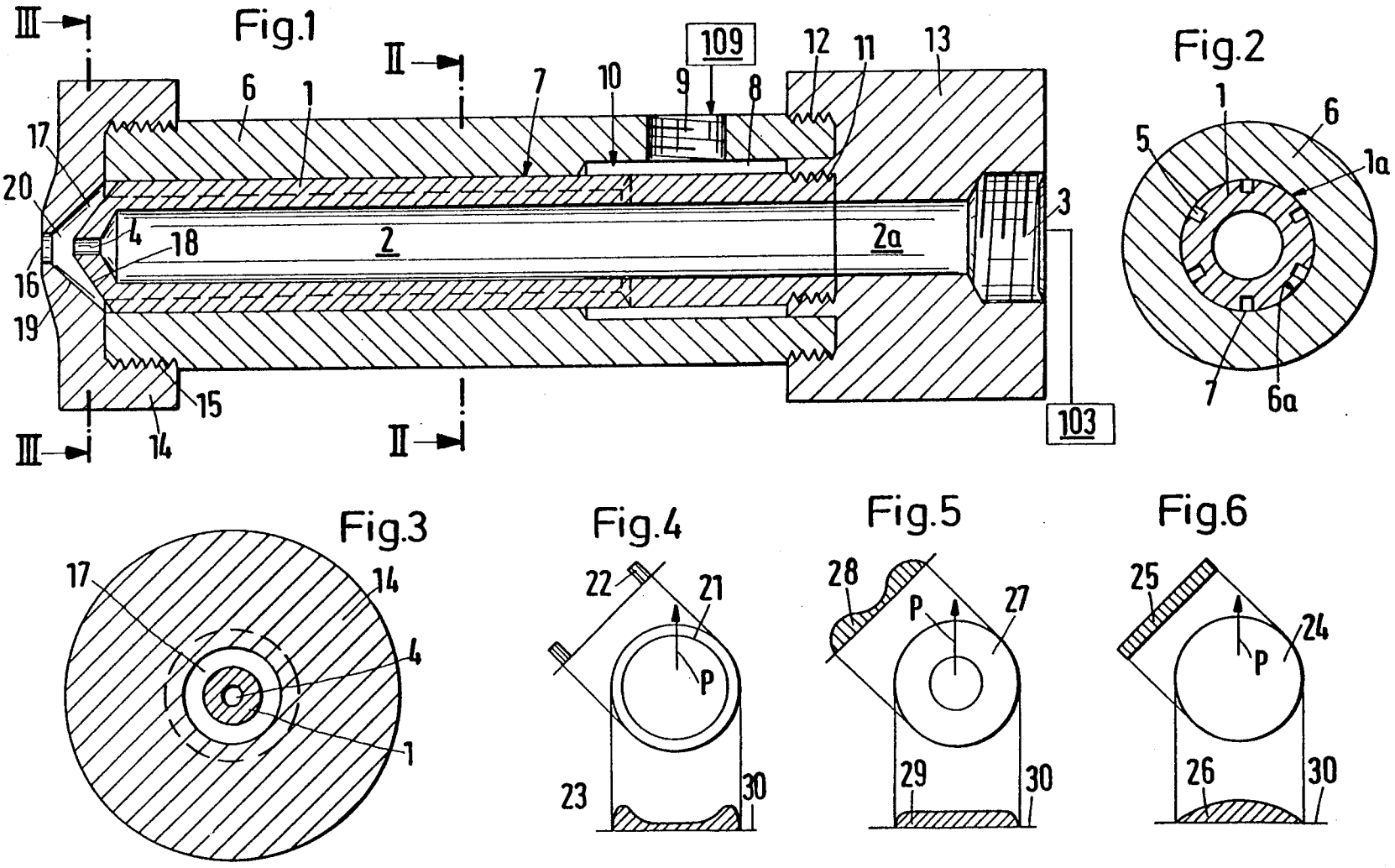
FIG. 1 is a partly schematic side elevational and partly central longitudinal sectional view of an apparatus which embodies one form of the invention.
FIG. 2 is a transverse sectional view substantially as seen in the direction of arrows from the line II—II in FIG. 1.
FIG. 3 is a transverse sectional view substantially as seen in the direction of arrows from the line III—III in FIG. 1.
FIG. 4 is a schematic front elevational view of the discharge end of a conventional apparatus and further shows, in two different views, the configuration of the discharged stream of viscous material prior and subsequent to contact with a substrate.
FIG. 5 is a schematic front elevational view of the discharge end of the improved apparatus and further shows the filament of viscous material in section prior to and after contact with a substrate.
FIG. 6 is a similar view of the discharge end of a further apparatus.

Referring first to FIGS. 1 to 3, there is shown an apparatus which can apply a layer 29 (FIG. 5) to a substrate 30. The apparatus comprises an elongated straight pipe 1 serving as one component of a means for confining an elongated stream of viscous material to flow along a straight path within an axial passage 2. The rear end portion of the pipe 1 has external threads 11 in mesh with the complementary internal threads of a holder 13 which is further provided with a passage 2*a* constituting a coaxial extension of the passage 2 and having an inlet 3 connected to a suitable source 103 of pressurized viscous material, such as an adhesive or a sealing compound having a viscosity preferably in excess of 100 cSt.

The front end of the pipe 1 defines a relatively small circular orifice 4 which constricts the flow of the stream of viscous material along its path and discharges a filament-shaped flow of such material into a chamber 17 bounded by a conical front surface 18 of the pipe 1 and a conical internal or rear surface 19 of an internally threaded cap 14 constituting another component of the aforementioned confining means. The mating threads of the cap 14 and the pipe 1 are shown at 15. The central portion of the cap 14 is provided with a relatively large orifice 16 which is aligned with the orifice 4 and receives viscous material as well as compressed gaseous fluid (e.g., air) from the central portion 20 of the chamber 17.

The cylindrical external surface 1*a* of the pipe 1 is immediately adjacent the cylindrical internal surface 6*a* of an elongated tube forming part of a distributor for compressed gaseous fluid (hereinafter called air for short). The external surface 1*a* is provided with six equidistant axially parallel grooves 5 the front ends of which communicate with the chamber 17 and the rear ends of which communicate with a tubular compartment 10 constituted by a recess 8 in the internal surface 6*a* of the tube 6. The internal surface 6*a* overlies the grooves 5 so that each such groove constitutes an elongated channel 7 serving to convey compressed air from the compartment 10 into the chamber 17 when the apparatus is in actual use. The tube 6 has a substantially radially extending lateral inlet 9 which is connected with a source 109 of compressed air. The source 109 comprises, or can be combined with, means for pulsating the pressure of air which is admitted into the compartment 10 and thence into the chamber 17 through the channels 7. The mating threads of the tube 6 and holder 13 are shown at 12.

The conical surfaces 18 and 19 bounding the chamber 17 taper toward the central longitudinal axis of the apparatus (in the direction of flow of the stream of viscous material) from the source 103 toward the substrate 30. The latter is moved transversely of the axis of the apparatus and/or vice versa during application of the layer 29.

When the apparatus is in use, the passage 2 receives a continuous stream of viscous material from the source 103 through the inlet 3 and passage 2*a* of the holder 13. The orifice 4 reduces the stream to a filament which enters the central portion 20 of the chamber 17 and is acted upon by compressed air which is supplied by the channels 7. The channels 7 receive currents of compressed air from the compartment 10 which, in turn, receives compressed air from the source 109 through the inlet 9. The pipe 1 cooperates with the tube 6 to break up the tubular current of compressed air in the compartment 10 into six equal straight currents which flow in parallelism with the axis of the pipe 1 and enter the radially outermost portion of the chamber 17 to thereupon flow radially inwardly as well as forwardly prior to acting upon the filamentary stream of viscous material which is in the process of advancing from the orifice 4 toward and into the orifice 16. Compressed air contacts the filament of viscous material in the central portion 20 of the chamber 17 without any, or without any appreciable, tangential component of flow such as would tend to impart to the filament a swirling motion.

It has been found that, even if the flow of compressed air from the discharge end or ends of one or more channels 7 toward the central portion 20 of the chamber 17 is not exactly radial, this does not adversely affect the configuration of the stream of viscous material which enters the orifice 16 because the irregularities of flow of air currents in the chamber 17 balance or neutralize each other. Otherwise stated, the action of currents of air upon the filament of viscous material in the central portion 20 of the chamber 17 is symmetrical and, therefore, the filament does not exhibit a tendency to swirl on its was toward, through and beyond the orifice 16 of the cap 14.

Successive increments of the filament of viscous material leave the apparatus via orifice 16 jointly with compressed air. This results in additional constriction and thinning out of the filament. The air which leaves the chamber 17 via orifice 16 expands and forms a guide cone which surrounds the viscous material on its way toward the substrate 30. The filament which is surrounded by the guide cone of air performs a certain amount of circulating and wobbling movement due to unavoidable instabilities, and such filament ultimately impinges upon the substrate 30 to form the layer 29.

Since the filament of viscous material is not compelled to carry out a swirling movement which would result in further constriction of the filament, the improved apparatus can be operated with relatively high air pressures and can discharge relatively large quantities of viscous material before the filament of viscous material begins to break up into discrete sections. The absence of swirling movement entails a practically complete absence of centrifugal forces which, in turn, renders it possible to intentionally raise the pressure of compressed air until the filament breaks up into a series of discrete sections. This presents no problems because the sections of the broken up filament remain confined within the aforediscussed guide cone of air issuing from the chamber 17 via orifice 16 of the cap 14. It has been found that the improved apparatus operates properly even if the pressure of viscous material varies within an extremely wide range (e.g., between 2 and 60 bar) and even if the pressure of compressed air also fluctuates within a very wide range (such as between 0.5 and 5 bar). It is advisable to maintain the pressure of compressed air, or any other selected gaseous fluid, below the pressure of viscous material.

The operator in charge of forming the layer 29 can vary the pressure of air and/or the pressure of viscous fluid in order to achieve a desired distribution of viscous material in the layer 29. As shown in FIG. 5, a presently preferred distribution is an at least substantially uniform distribution of viscous material all the way between the two marginal portions of the applied layer 29.

FIG. 4 shows the making of a layer 23 which is obtained when the filament of viscous material is caused or permitted to perform a swirling motion as called for in the aforediscussed U.S. Pat. No. 4,995,333 to Keller et al. As can be seen in FIG. 4, the front end of the apparatus of Keller et al. discharges a thin annular stream 21 having a cross-sectional configuration as shown at 22 and, when such viscous material reaches the substrate 30, it forms a layer 23 which contains a substantial quantity of viscous material along its marginal portions but much less material in the central zone of the layer. The arrow P indicates in FIG. 4 the direction of movement of the discharge end of the patented apparatus relative to the substrate 30 and/or vice versa. The layer 23 is formed as a result of deposition of a succession of rings 21 of viscous material on the substrate 30 when the substrate and the patented apparatus are caused to perform a relative movement in the direction of arrow P.

If the manner of discharging viscous material is modified as shown in FIG. 6, deposition of the uniform film 25 of viscous material 24 on a substrate 30 results in the development of a layer 26 which has a considerable thickness at the center and tapers toward its marginal portions.

The presently preferred method of applying viscous material is somewhere between the two extremes which are shown in FIGS. 4 and 6. Thus, and as shown in FIG. 5, viscous material 27 which issues from the orifice 16 of the confining means including the holder 3, pipe 1 and cap 14 has a cross-sectional outline as shown at 28 while it is caused to advance beyond the orifice 16, and this results in the formation of a layer 29 whose thickness is constant or nearly constant all the way between the two marginal portions. Such desirable layer 29 is obtained due to the integrating effect of the component of movement in the direction of arrow P. It will be noted that the layer 29 is devoid of substantial accumulations of viscous material along its marginal portions (compare with the layer 23 of FIG. 4) and/or of substantial accumulations of viscous material at the center (compare with the layer 26 of FIG. 6).

In order to alter the width of the layer 29, the operator simply changes the distance of the larger orifice 16 from the smaller orifice 4 in the axial direction of the pipe 1. This results in a change of the shape of the aforediscussed guide cone of air outside of the orifice 16. The dimensions of the layer 29 can be varied also by changing the distance of the orifice 16 from the substrate 30 for the layer 29. The cross-sectional outline of the layer 29 remains satisfactory even if the distance of the orifice 16 from the substrate 30 is varied within a wide range. Changes of the distance of the orifice 16 from the substrate 30 can also be resorted to in order to avoid splashing of viscous material upon the surface of the substrate 30 beyond the marginal portions of the applied layer 29. Contamination would be likely to take place if droplets of viscous material were permitted to rebound upon impact against the substrate 30.

An important advantage of the improved method and apparatus is that the tangential components of flow of air currents issuing from the channels 7 are at least strongly suppressed so that the filament of viscous material advancing through and beyond the orifice 16 does not exhibit a tendency to perform a swirling movement. Thus, the filament is not acted upon by pronounced centrifugal forces to form rings of the type shown (at 21) in FIG. 4. Deflection, if any, from an ideal path (axially of the pipe 1) downstream of the nozzle 16 is attributable to unavoidable instability of the rate of admission of compressed air. This also leads to a certain circular movement of the filament between the orifice 16 and the substrate 30; however, the diameters of the circles are relatively small (considerably less than the width of the layer 29) and this results in the formation of a layer having a thickness which is much more uniform than that of the layer 23 in FIG. 4. Thus, if the substrate 30 is to be bonded to another part having a plane surface coming in contact with the exposed side of the layer 29, the bond is much more satisfactory than the bond with a substrate bearing a layer 23 because the plane surface of the other part contacts the entire exposed side of the uniform layer 29.

Another advantage of the improved method and apparatus is that one can operate with a gaseous fluid medium and with a viscous material at elevated pressures. Thus, when the filament of viscous material is acted upon by a gaseous fluid which causes the filament to perform a swirling movement, this invariably entails a tearing of the filament because the latter is made thinner as a result of impingement by currents of gaseous fluid as well as due to its swirling motion. Tearing of the swirling filament takes place even at relatively low pressures of gaseous fluid. Once the filament tears, its sections or fragments which are acted upon by pronounced centrifugal force) tend to fly away and to contaminate the substrate in regions other than those which are to be coated with a layer of viscous material. As already explained hereinabove, it is now possible to greatly increase the pressure of viscous material as well as the pressure of compressed gas because the limit at which a filament (which does not swirl) tends to break is much higher than in the case of a filament which is caused to perform a swirling movement. Furthermore, and as also discussed hereinbefore, tearing of a non-swirling filament is of no consequence (or less undesirable than tearing of a swirling filament) because the non-swirling filament is confined within the guide cone of gaseous fluid which issues through the orifice 16, and such cone prevents spreading of viscous material beyond the boundaries of the layer 29. Therefore, it is now possible to greatly increase the speed of formation of a desirable layer 29 without risking contamination of the surface around the layer 29. Consequently, the improved method and apparatus can be put to use for the application of relatively thick layers 29 (i.e., layers which contain relatively large quantities of viscous material) as well as for rapid application of relatively thin layers. Still further, the improved apparatus is sufficiently reliable to warrant its handling by automatons with attendant savings in manual labor and cost.

The provision of grooves 5 in the external surface 1*a* to form the channels 7 as a result of insertion of the pipe 1 into the tube 6 has been found to contribute to simplicity and lower cost of the apparatus. Moreover, the direction of flow of currents of compressed gaseous fluid from the compartment 10 into the chamber 17 can be selected with a high degree of accuracy. In its simpler or simplest form, the apparatus can operate properly with a distributor system which employs three equidistant channels 7. Thus, three currents of compressed gaseous fluid will suffice to properly center the filament of viscous material which emerges from the orifice 4 of the pipe 1. However, it is presently preferred to provide between six and ten channels 7 in order to even further enhance the centering action upon the filament of viscous material and to even further reduce the likelihood of swirling of the filament on its way toward the substrate. Currents of gaseous fluid issuing from the discharge ends of between six and ten channels 7 can form a practically gap-free flow which properly centers the filament of viscous material and practically excludes the development of undesirable swirling movement.

The orifice 16 establishes a point where the filament of viscous material tends to wobble or pivot on its way from the central portion 20 of the chamber 17 toward the substrate 20. Such stray movements of the filament of viscous material are damped and restricted by the cone of gaseous fluid which surrounds the viscous material downstream of the orifice 16. If it is desired to apply a wider or narrower layer 29 of viscous material, the orifice 16 is simply caused to move toward or away from the orifice 4. If the operator selects a relatively steep cone with a small apex angle, the distance of the orifice 16 from the substrate 30 can be increased without risking any splashing of viscous material at either side of the layer 29. The cone holds the applied viscous material against rebounding on impact against the substrate.

The utilization of a gaseous fluid whose pressure varies in pulsating fashion is desirable in many instances because this contributes to more uniform distribution of viscous material in the layer 29.

Though the channels 7 need not be parallel to the axis of the pipe 1 (as long as they guide the currents of compressed gaseous fluid in a manner to avoid swirling of the viscous material), the illustrated design (with channels 7 extending in parallelism with the passage 2) is preferred at this time because it contributes to compactness of the apparatus, i.e., the channels 7 can be disposed at a small radial distance from the path for the flow of viscous material from the source 103 into the chamber 17.

The provision of grooves 5 in the external surface 1*a* of the pipe 1 also contributes to simplicity and compactness of the improved apparatus. Such grooves can be formed in available milling or other suitable machines. It is equally within the purview of the invention to provide the grooves 5 in the internal surface 6*a* of the tube 6 and/or to provide the recess 8 in the external surface 1*a* of the pipe 1 or partly in the surface 1*a* and partly in the surface 6*a*.

If the rear ends of the channels 7 extend all the way or at least close to the inlet or inlets 9, such design ensures a somewhat turbulent and hence uniform distribution of compressed gaseous fluid among the channels and more predictable impingement of gaseous fluid upon the filament of viscous material in the chamber 17. It has been found that the orientation of discrete currents of gaseous fluid in the channels 7 is quite satisfactory if the length of a channel is at least three times the diameter of the annulus which is formed by the channels. With reference to FIGS. 1 and 2, the diameter of the external surface 1*a* should not exceed one-third of the length of a channel 7.

The compartment 10 can receive compressed gaseous fluid by way of two or more lateral inlets 9. The provision of one or more radial inlets is preferred at this time because this ensures a certain reduction of turbulence and a reduction of tendency of the currents entering the channels 7 to impart to the viscous material a swirling motion during passage through the chamber 17 and outside of the cap 14.

The cross-sectional area of the chamber 17 (in planes extending at right angles to the axis of the pipe 1) is preferably constant or nearly constant. This ensures that the speed of the gaseous fluid passing through the chamber 17 remains substantially constant.

The provision of orifices 4 and 16 immediately or closely upstream and downstream of the chamber 17 ensures that the chamber 17 receives a filament of viscous material and that the combined flow of viscous material and gaseous fluid from the central portion 20 of the chamber 17 is controlled in the aforediscussed manner with beneficial effects concerning the thickness of the layer 29, avoidance of contamination of the substrate 30 and the possibility of varying the width of the layer 29 within a wide range.

The improved method and apparatus can be modified in a number of additional ways without departing from the spirit of the invention. For example, the inlet 9 for compressed air or another gaseous fluid can be provided in the holder 13. The gaseous fluid can be heated prior to entering, or upon entry into, the compartment 10. Furthermore, and as already mentioned before, the rear ends of the channels 7 can extend all the way or practically all the way to the inlet 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for applying a substantially strip-shaped layer of viscous material to a substrate, comprising means for confining a filament-shaped stream of pressurized viscous material to movement along a predetermined path in a direction toward a substrate, said confining means defining a chamber surrounding a predetermined portion of said path and said confining means having substantially conical surfaces bounding said chamber and tapering in said direction toward said path, said chamber having an exit orifice along said path and downstream of said chamber; and a distributor having at least one inlet connected to a source of compressed gaseous fluid, said distributor defining a compartment which receives fluid through said at least one inlet and said distributor further defining a plurality of discrete channels connecting said compartment with said chamber, said channels having a distribution and orientation relative to said path such that the gaseous fluid entering said chamber and impinging upon the stream in said portion of said path has components of flow in said direction and radially of said path but is substantially devoid of components tangentially of said path;

wherein said compartment surrounds said path and is located upstream of said chamber, said channels being substantially equidistant from each other circumferentially of said compartment;

wherein said confining means comprises a pipe which surrounds said path and has an external surface and a flow constricting orifice for viscous material, said orifice defining a second portion of said path adjacent and upstream of said chamber, said flow constricting orifice having a smaller cross-section than said exit orifice; and wherein said channels have outlet ends immediately adjacent an outermost portion of one of said conical surfaces.

2. The apparatus of claim 1, wherein said channels are parallel to said path.

3. Apparatus for applying a substantially strip-shaped layer of viscous material to a substrate, comprising means for confining a filament-shaped stream of pressurized viscous material to movement along a predetermined path in a direction toward the substrate, said confining means defining a chamber surrounding a predetermined portion of said path and said confining means having substantially conical surfaces bounding said chamber and tapering in said direction toward said path; and a distributor having at least one inlet connected to a source of compressed gaseous fluid, said distributor defining a compartment which receives fluid through said at least one inlet and said distributor further defining a plurality of discrete channels connecting said compartment with said chamber, said channels having a distribution and orientation relative to said path such that the gaseous fluid entering said chamber and impinging upon the stream in said portion of said path has components of flow in said direction and radially of said path but is substantially devoid of components tangentially of said path.

wherein said confining means comprises a pipe which surrounds said path and has an external surface and a flow constricting orifice for viscous material, said orifice defining a second portion of said path adjacent and upstream of said chamber; and wherein said distributor includes a tube surrounding said pipe and having an internal surface adjacent said external surface, said internal and external surfaces bounding said compartment and said channels including grooves provided in at least one of said internal and external surfaces.

4. The apparatus of claim 3, wherein said compartment is a recess in at least one of said internal and external surfaces.

5. The apparatus of claim 3, wherein said grooves are provided in said external surface and said compartment is provided in said internal surface.

6. Apparatus for applying a substantially strip-shaped layer of viscous material to a substrate, comprising means for confining a filament-shaped stream of pressurized viscous material to movement along a predetermined path in a direction toward a substrate, said confining means defining a chamber surrounding a predetermined portion of said path and said confining means having substantially conical surfaces bounding said chamber and tapering in said direction toward said path; and a distributor having at least one inlet connected to a source of compressed gaseous fluid, said distributor defining a compartment which receives fluid through said at least one inlet and said distributor further defining a plurality of discrete channels connecting said compartment with said chamber, said channels having a distribution and orientation relative to said path such that the gaseous fluid entering said chamber and impinging upon the stream in said portion of said path has components of flow in said direction and radially of said path but is substantially devoid of components tangentially of said path;

wherein said compartment surrounds said path and is located upstream of said chamber, said channels being substantially equidistant from each other circumferentially of said compartment;

wherein said confining means comprises a pipe which surrounds said path and has an external surface and a flow constricting orifice for viscous material, said orifice defining a second portion of said path adjacent and upstream of said chamber;

wherein said channels have outlet ends adjacent an outermost portion of one of said conical surfaces; and wherein said distributor surrounds at least a portion of said confining means and said channels extend from said chamber substantially to said at least one inlet, said at least one inlet being located upstream of said chamber.

7. The apparatus of claim 6, wherein said channels are elongated and have a length and together form an annulus having a diameter measuring not more than one third the length of said channels.

8. The apparatus of claim 6, wherein said distributor includes a tube which at least partially surrounds said confining means and said at least one inlet extends laterally of said compartment.

9. The apparatus of claim 8, wherein said at least one inlet is disposed substantially radially of said tube and said compartment.

10. The apparatus of claim 6, wherein said distributor defines between six and ten channels.

11. The apparatus of claim 6, wherein said chamber has a substantially constant cross-sectional area in said direction.

12. The apparatus of claim 6, wherein said confining means has a first orifice forming part of said path immediately upstream of said chamber and a larger second orifice forming part of said path immediately downstream of said chamber.

* * * * *